US009174705B2

(12) United States Patent
Eilertsen

(10) Patent No.: US 9,174,705 B2
(45) Date of Patent: Nov. 3, 2015

(54) COMPENSATED LASHING OF TENDER ASSIST DRILLING UNIT TO A FLOATING PRODUCTION FACILITY

(71) Applicant: Terje W. Eilertsen, Houston, TX (US)

(72) Inventor: Terje W. Eilertsen, Houston, TX (US)

(73) Assignee: Terje W. Eilertsen, Houston, TX (US)

( * ) Notice: Subject to any disclaimer, the term of this patent is extended or adjusted under 35 U.S.C. 154(b) by 0 days.

(21) Appl. No.: 14/250,717

(22) Filed: Apr. 11, 2014

(65) Prior Publication Data

US 2014/0305361 A1 Oct. 16, 2014

Related U.S. Application Data

(60) Provisional application No. 61/811,057, filed on Apr. 11, 2013.

(51) Int. Cl.
*B63B 21/00* (2006.01)
*B63B 21/16* (2006.01)

(52) U.S. Cl.
CPC ..... *B63B 21/16* (2013.01)

(58) Field of Classification Search
USPC ..... 114/230.22, 230.24, 214, 215
IPC ..... B63B 2021/005,21/16
See application file for complete search history.

(56) References Cited

U.S. PATENT DOCUMENTS

| | | | | |
|---|---|---|---|---|
| 3,871,527 | A * | 3/1975 | Schimmeyer et al. | 212/308 |
| 4,155,538 | A * | 5/1979 | Claassen | 254/277 |
| 4,573,592 | A * | 3/1986 | Oliphant | 212/294 |
| 5,351,430 | A * | 10/1994 | Hystad | 43/9.1 |
| 2007/0119359 | A1 * | 5/2007 | Eilertsen | 114/230.2 |

* cited by examiner

*Primary Examiner* — Stephen Avila
(74) *Attorney, Agent, or Firm* — Duane Morris LLP

(57) ABSTRACT

A system of lashing a tender assist drilling unit (TADU) to a floating production platform includes a plurality of lashing lines reeved over a hydraulic-pneumatic tensioning system sheave assembly and a plurality of fixed anchor points to the above water line section of the production platform hull structure. The hydraulic-pneumatic tensioning device will, when in tensioning mode, compensate and control the relative movement between the two floating bodies. The hydraulic-pneumatic tensioning system will also enable lashing pre-tension adjustments during operations and fine-tuning of system performance can be done site-specific based on lessons learned. The hydraulic-pneumatic tensioning device will, when in hydraulic lock mode, enable a fixed lashing line system. This will by the means of the first units mooring winch system enable; a winch-in for close proximity during heavy lifting; or an efficient lashing pay put during extreme weather preparation for increased separation between the two units.

13 Claims, 4 Drawing Sheets

COMPENSATED LASHING OF TENDER ASSIST DRILLING UNIT TO A FLOATING PRODUCTION FACILITY

RELATED AND CO-PENDING APPLICATIONS

This application claims priority to U.S. Provisional application entitled "Compensated Lashing of Tender Assist Drilling Unit to A Floating Production Facility" Ser. No. 61/811,057, filed on 11 Apr. 2013, the entirety of which is incorporated herein by reference.

BACKGROUND

The present subject matter relates to floating offshore structures and particularly to a system for connecting two floating structures by wire rope lashing to obtain a controlled relative separation and to achieve the lashing loads to be within predefined maximum lashing tension load values.

The need for this type of lashing technology is especially applicable when implemented with a tender assist drilling unit (TADU) for an offshore production facility based drilling and or completion operation.

In many deep water drilling and production installations, a floating tender assist drilling unit (TADU) is lashed to an adjacent offshore production facility or platform to assist in the drilling and production operations. This TADU can be any type of semi submersible or barge hull form. Both the TADU and the platform are typically moored to the seabed, and they are lashed to each other so as to restrict relative movement between the two structures, thereby to facilitate the transfer of drilling consumables, supplies and personnel from one structure to the other and hook-up of control and fluid lines between the two structures. The lashing mechanism must be capable of maintaining the relative movement within predefined limits that allow normal operation throughout environmental conditions that can be expected during the course of a normal year (a "one-year environment"), and that allow limited operations, including the maintenance of drilling circulation and control, throughout worst-case conditions to be expected during a typical ten-year period (a "ten-year environment"). The one year and ten year environments are established and described by Metocean.

In a 100-year extreme weather condition the system must be capable of increasing the separation distance to a storm safe distance and at the same time function as a 100-year storm safe coupled mooring system. This is obtained by having the four off lashing lines connected to the TADU forward mooring winches for separation control during storm separation and pull back for normal operation.

The present system for coupling two bodies is either a fixed wire/rope/chain coupling lines by doing a fixed length connection between the two bodies.

The downside of this fixed length type of lashing is the lack of control over the lashing loads acting between the two floating structures. As a consequence this can add to the maximum overall horizontal acceleration on the drilling equipment set installed onto the offshore production facility, with the consequence of potentially de-rating of the drilling facility operational specifications and subsequent reduction of drilling efficiency (drilling up-time).

Additionally, this type of lashing will require a full disconnect between the two floating structures during an extreme weather event to be storm safe. This disconnect will require assistance of additional support vessels and add time for the overall extreme weather preparation window required.

An alternative solution has been to utilize a wire/nylon/wire lashing hawser for a spar based production facility. This system will require an extensive length of nylon section that can only be achieved by routing the nylon-based hawser down the spar hull. This system is described in patent publication US2007/0119359 the entirety of which is incorporated by reference.

The down side of this system is that it is specific to spar hulls. It is partly submerged by having the majority of the nylon-hawser routed down the spar hull. Additionally, this is not a system that lends itself to be retrofitted. It is not possible to adjust any stiffness characteristic for this system after installation. Also, this system will require separate fixed lashing lines to be installed during close proximity of the two floating structures during heavy lift operation.

The present disclosed subject matter addresses these shortcomings, for example, not being floating structure independent. It may be used on any type of floating structure like; semi-submersible, tension leg platform, spar, barge or mono hull. The disclosed subject matter also addresses the need for relative separation control between the two floating bodies and the lashing tension load control. It also eliminates the necessity for disconnect during extreme weather to make the structures storm safe. It also addresses the need to have an additional fixed close proximity lashing during heavy load transfer between the two floating structures.

Broadly, the present subject matter is a system for lashing a first floating structure, such as a TADU, to a second floating structure, such as a production platform, which include a set of lashing lines, each extending from an anchor point of the first floating structure through a hydraulic-pneumatic tensioner system to a fixed anchor of the second floating structure.

In a preferred embodiment each of the lashing line first or free ends are connected to a winch cable that is wound on a winch on the first structure or TADU. The lashing is preferably a wire rope connected by suitable connection means connected to an anchor wire winch of the first floating structure.

The lashing wire is reeved over upper and lower sheaves, or sheave cluster of the hydraulic-pneumatic tensioner system. The lashing wire is routed over to the second floating structure and secured to an anchor mechanism at the structure. This anchor can either be a fixed anchor or a rotating anchor for the purpose of easing slipping and cutting of the lashing wire as part of the scheduled maintenance of the lashing system.

These and many other advantages of the present subject matter will be readily apparent to one skilled in the art to which the invention pertains from a perusal of the claims, the appended drawings, and the following detailed description of preferred embodiments.

DETAILED DESCRIPTION

Figure 1:
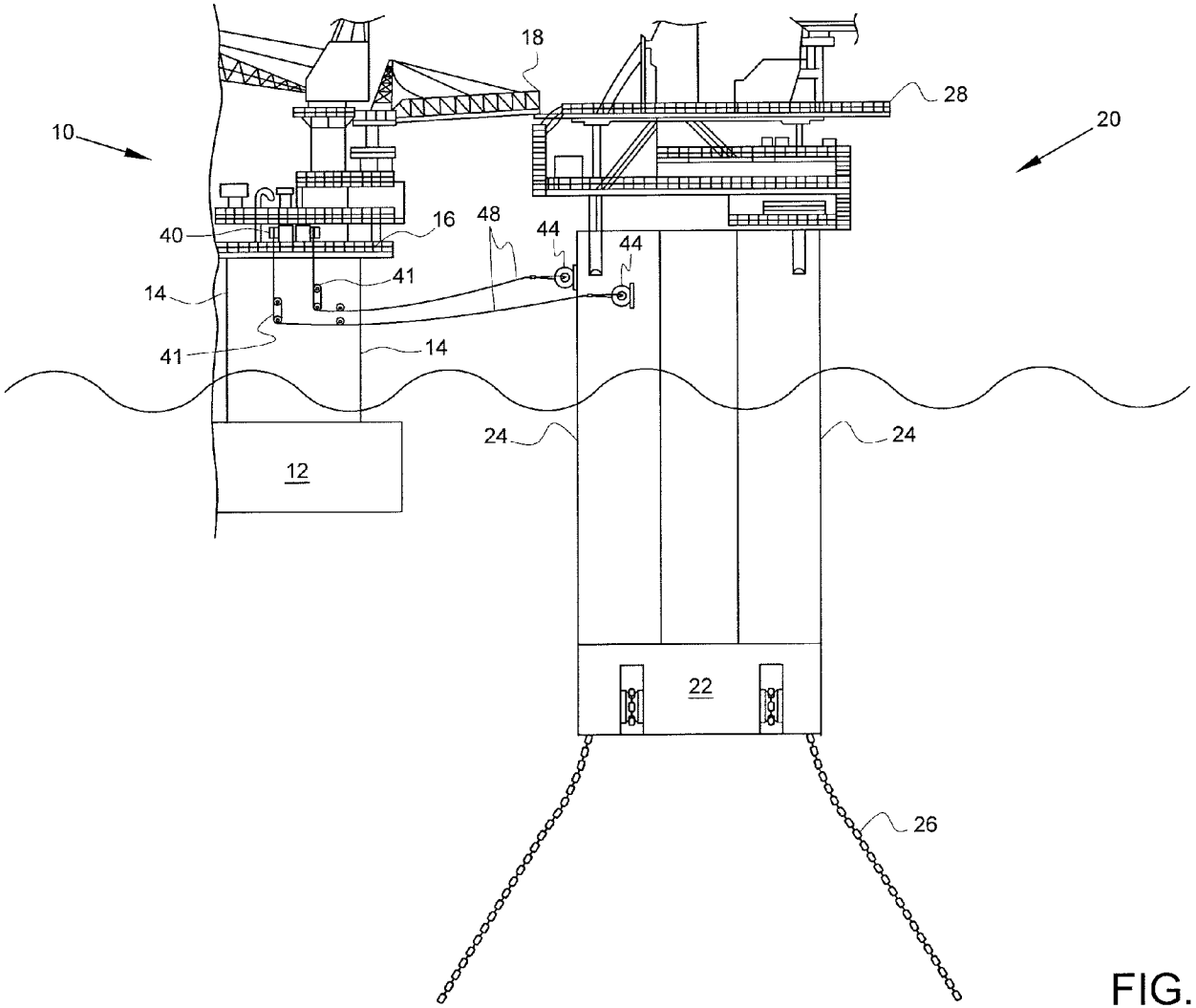
FIG. 1 is an elevation view of the TADU and a second floating Tension Leg Platform based structure linked together by a lashing system in accordance with the present invention.
Figure 2:
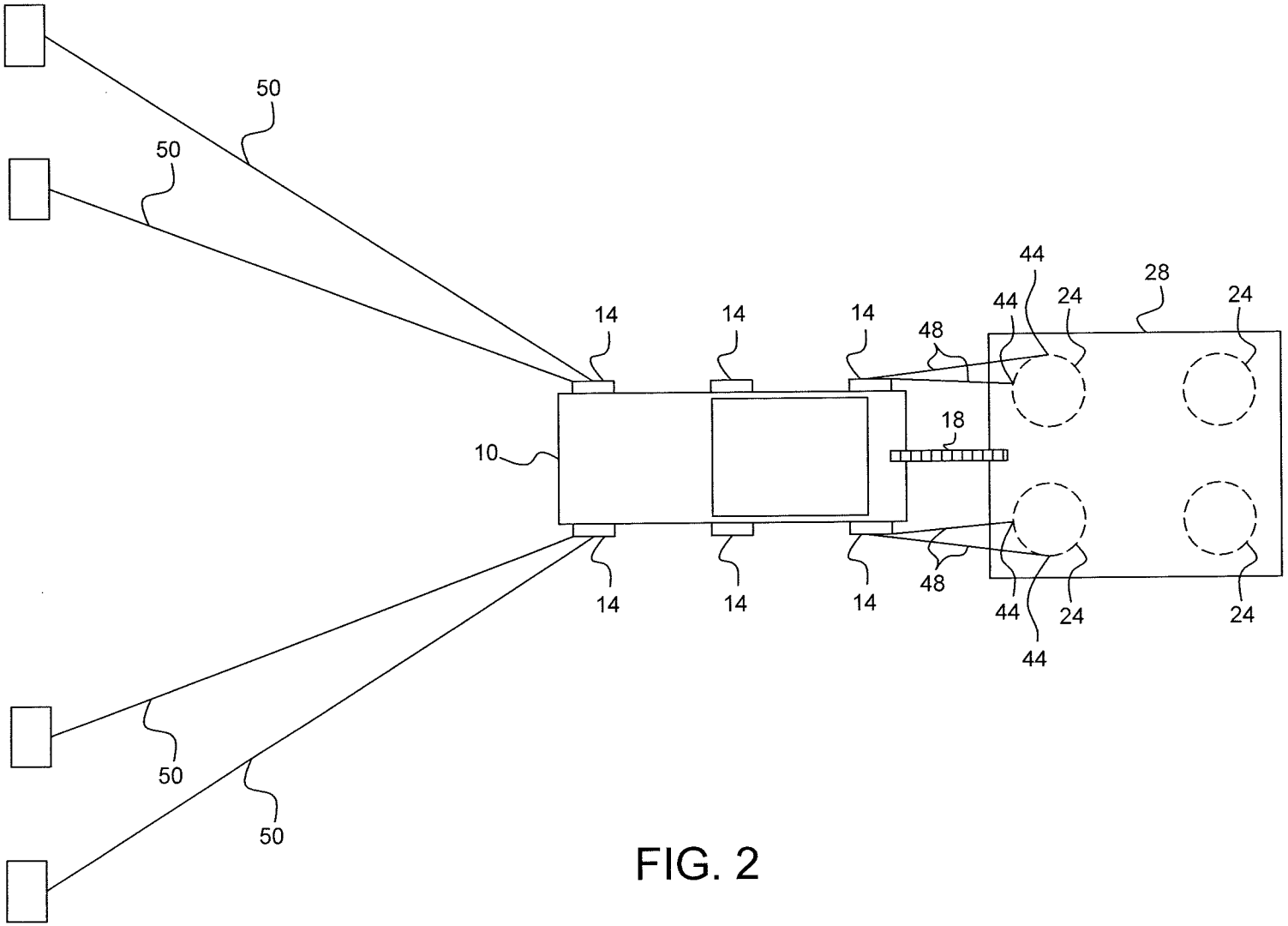
FIG. 2 is a plan view of a TADU and a platform of FIG. 1 linked together by lashing system of the present invention.

Referring now to the drawings, a first floating structure 10 is shown, in FIGS. 1 and 2, linked to a second floating structure 20 by a lashing system in accordance with a preferred embodiment of the disclosed subject matter. In this exemplary embodiment, the first floating structure 10 is a tender assist drilling unit (TADU), and will be referred to as such in the following description. The second floating structure 20 is an offshore drilling and production platform of the Tension Leg Platform (TLP) type, and will be referred to as a "platform" in the following description. It should be understood, however, that the present disclosed subject matter is not limited to use with the specific types of floating structures described herein. For example, the second floating structure 20 can be any other platform or structure supporting a deck structure. Similarly, the first floating structure 10 can be any type of floating structure that needs to be linked or lashed to another floating structure, such as a platform. It is further noted that the disclosed subject matter may also be implemented where the second structure is not a floating structure, however, its benefits are greater when both structures are floating.

As shown, the TADU 10 includes a hull that has a submerged portion 12, from which extend a plurality of columns 14 that support a deck 16 on which various equipment and structures used in drilling and production operations are located. Also secured to the deck 16 is a gangway 18 having a distal end adapted to be secured to the platform when the structures 10, 20 are lashed together by the present subject matter, as described below.

In the described embodiment, the platform 20 is a TLP platform, the platform 20 has a hull comprising a pontoon 22, columns 24, tendons 26 for mooring and a deck structure 28. A deck structure 28 is secured to the top of hull 20, supported above the surface of the water, and it is adapted to receive and secure the distal end of the gangway 18 when the structures 10 and 20 are lashed together by the present subject matter. The TLP structure 20 is well-known in the art.

As shown in FIGS. 1 and 2, the platform 20 is secured to the seabed by a plurality of platform tendons 26. Similarly, the TADU 10 is secured to the seabed, at a location closely adjacent to the platform 20, by a plurality of TADU mooring lines 50, after having been moved to that location, either under its own power (if self-propelled), or by tugboats (not shown).

A plurality of winches 40 are provided near the forward end of the TADU 10, preferably on the two forward-most columns 14 of the TADU hull. In a preferred embodiment, each of the two forward-most columns 14 carries two winches 40, for a total of four winches 40. Mounted on the forward-most columns 14 below each of the winches 40 is the hydraulic-pneumatic tensioner system 41. A plurality of fixed anchor points 44 mounted on the upper part of the platform hull 20, such as on the column 24, on the side that would be lashed to the TADU 10.

Thus, as shown in FIG. 2, in the exemplary embodiment disclosed herein, there are four fixed anchor points 44, two at approximately the 10 o'clock position and two at approximately the 5 o'clock position on the TLP column 24 (looking from the TADU 10). It may be advantageous to provide idler sheaves at the 2 o'clock and 10 o'clock positions as well, to allow the TADU 10 to be lashed to either side of the platform 20. Additional idlers or fairleads may also be utilized. For each winch 40 and hydraulic-pneumatic tensioner unit 41 there is a fixed anchor point 44, on the platform hull 20. In the exemplary embodiment disclosed herein, each of the fixed anchor points are fixed to the platform column 24. In some situations, two or more of the hydraulic-pneumatic tensioner units 41 may utilize a common anchor point 44.

A plurality of lashing lines 48, preferably around 3 in. diameter, are employed to lash the TADU 10 to the platform 20 by means of the winches 40, hydraulic-pneumatic tensioner unit 41, and fixed anchor connections 44.

Figure 3:
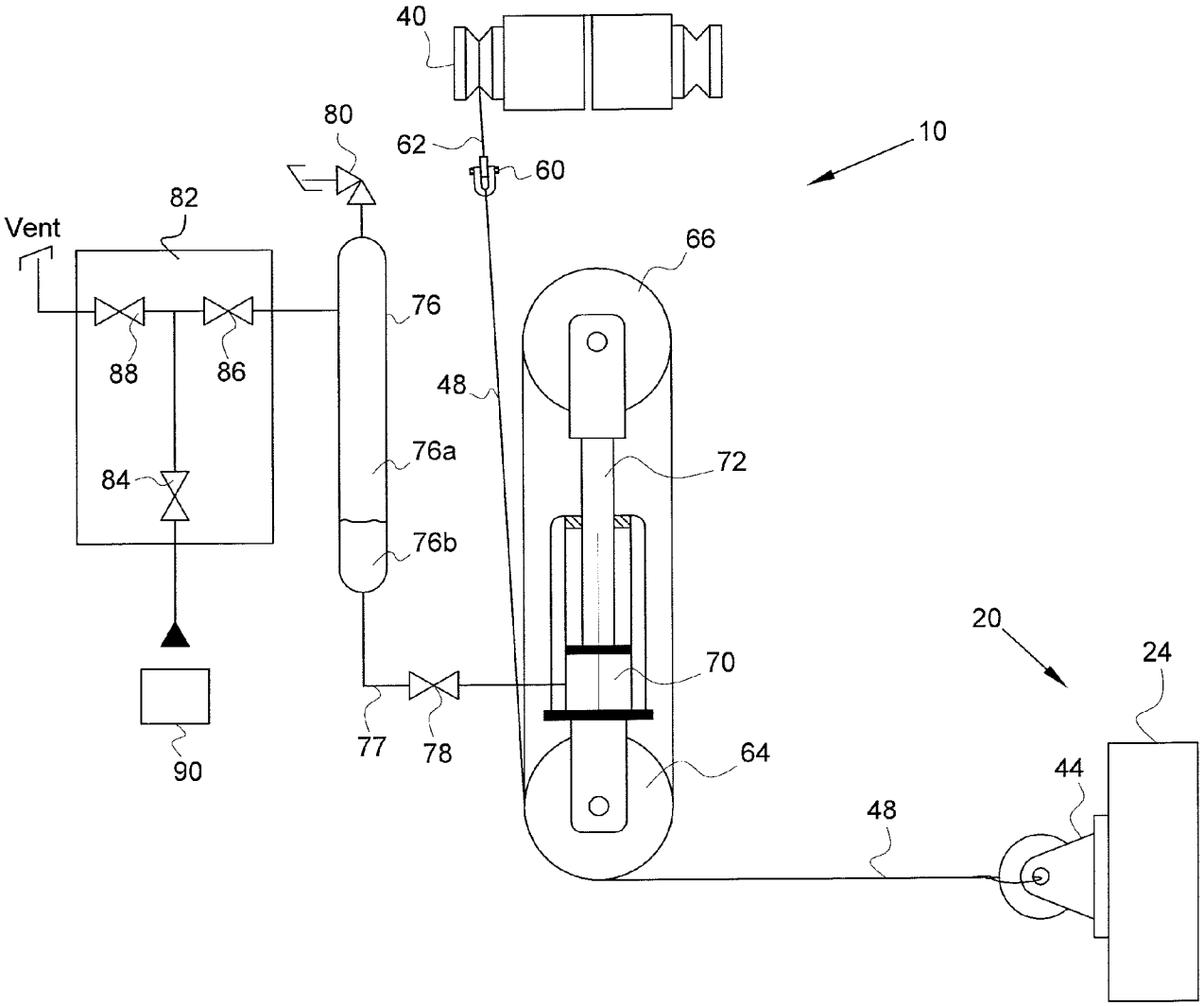
FIG. 3 is a schematic drawing of the hydraulic-pneumatic tensioning system including showing generic valve assembly, generic sheave cluster arrangement, generic lashing wire routing and the cylinder safety device to prevent "sling shot".

As best shown in FIG. 3 each lashing line 48 is preferably made of wire rope. The lashing line is at one free end connected by a suitable connector 60 to the mooring winch 40 mooring line 62. The lashing line is reeved over the hydraulic-pneumatic tensioner unit lower sheave assembly 64 and upper sheave assembly 66 back down to sheave assembly 64 and over to the platform 20 fixed anchor point 44, preferably located at the column 24. By having both sheave assembly 64 and sheave assembly 66 made up by dual sheaves system a 4:1 motion ratio between the cylinder stroke and connection line travel, a desired separation envelope of +/−30 feet can be obtained. Any number of sheaves ($N_s$) may be employed with the understanding while the motion ratio will increase as a function of $N_s$, the force required to maintain the desired tension in the lashings will also increase as a function of $N_s$.

The hydraulic-pneumatic tensioner system as shown in detail in FIG. 3 comprises of several components well known to the industry. The system includes a lower sheave assembly 64 fixed to a cylinder body 70. The cylinder rod 72 is outfitted with an upper sheave assembly 66. The cylinder is connected to a gas/fluid accumulator 76 (gas and fluid are shown as **76*a* and 76*b* respectively) by a fixed pipe spool 77, with an in line "sling shot" valve 78. The purpose of the "sling shot" valve 78 is a rapid closure of the hydraulic line between the accumulator and the cylinder to prevent an uncontrolled out stroke of the cylinder rod 72 in the event of a sudden lashing line 48** failure during operation, the "sling shot" valve can also be described as a fail safe valve. The references to upper and lower are for ease of description only, as several orientations of the sheaves are envisioned.

The accumulator 76 is sized to accommodate the required gas volume needed to maintain a predefined tension system stiffness characteristic and also to accommodate the required nominal and maximum pressure anticipated during operation. Generally the larger the accumulator's volume, the less the differential in pressure between the maximum stroke state, in which the rod is fully extended and the minimum stroke state in which the rod is fully retracted.

The accumulator is protected by pressure safety valve 80. A valve control panel 82 controls the accumulator. Increases in pressure are made by opening valve 84 and valve 86. Operating valve 86, which is operably connected to the accumulator 76, and valve 88 reduces pressure. Valve control panel is connected to high-pressure air system 90. The valves may be automatically controlled. Additionally, a pressure gauge is preferably included on the control panel. Manual control of the sling shot or fail safe value may also be enabled on the valve control panel.

Figure 4:
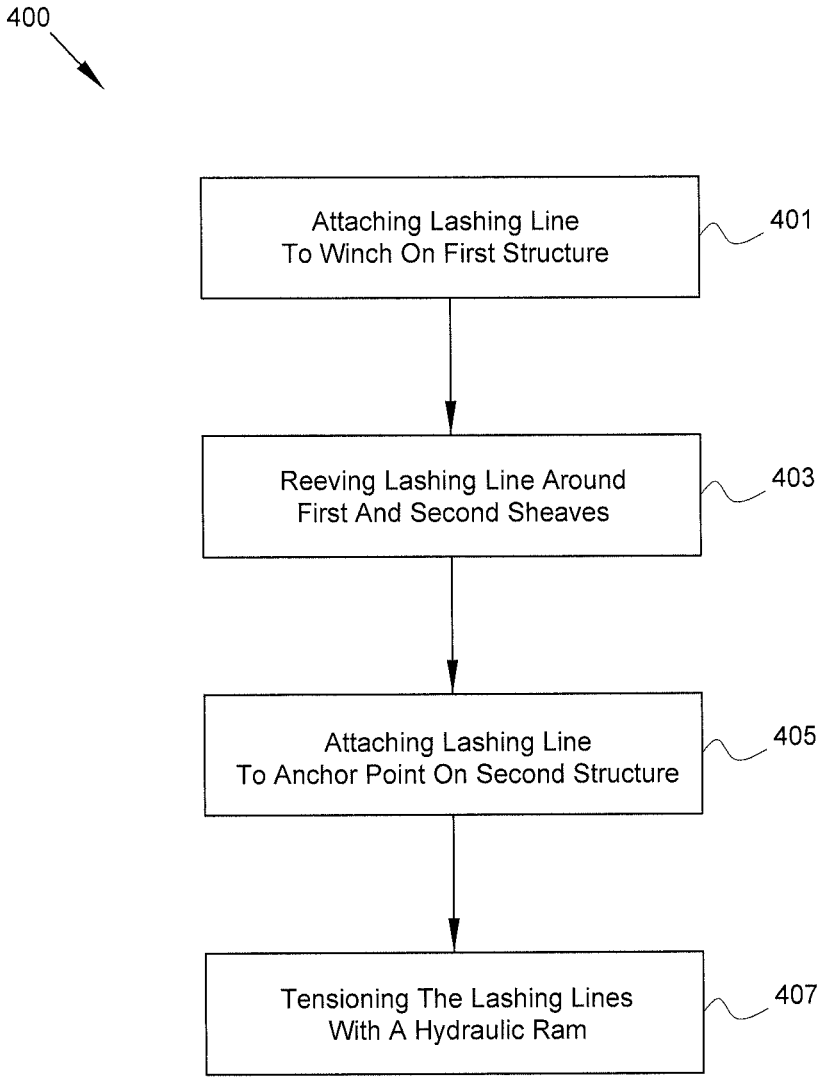
FIG. 4 is a flow diagram of a method of lashing two floating structures together according to an embodiment of the disclosed subject matter.

In operation, as shown in method 400 of FIG. 4, the TADU 10 is brought to the vicinity of the moored platform 20, as mentioned above. At least one of the winch cables 48 is assembled by connecting the mooring line section 62, as shown in block 401, and reeved through the hydraulic pneumatic tensioner system sheave assembly, as shown in block 403, and the second end connected to the platform 20 and fixed anchor point 44, as shown in block 405. This can be done on an anchor handling tug or "AHT" (not shown).

The TADU 10 is brought to the desired separation distance from the platform 20, and each remaining lashing line 48 is connected 60 with the mooring winch cable 62 and run through its associated sheave assemblies 64 and 66 and then has its free end connected to the anchor point 44 at the platform 20 column 24.

With the lashing lines 48 assembled and secured between the TADU 10 and the platform 20, the winches 40 may be employed to adjust the separation distance between the two floating structures to the optimum separation distance, which would typically be the optimum distance for securing distal end of the gangway 18 to its appropriate attachment fixture or location on the platform 20. The hydraulic-pneumatic tensioning system then tensions the lashing line with the hydraulic ram as shown in block 407. The hydraulic-pneumatic tensioning system will provide the required compensation of the relative distance between the TADU 10 and the platform 20 and lashing pretension to maintain a controlled separation while keeping the two structures at an optimum desired operating distance, typically a minimum of about 30 ft. in ordinary environmental conditions. The tension in the lashing line is a function of the set gas pressure and the stroke position of the rod (the stroke position can also be expressed as a percentage of maximum stroke). It is important to note that the range may be narrow as a function of the accumulator size, however, the hydraulic-pneumatic tensioning system increases the tension in the lashing line in response to the first structure 10 moving apart from the second structure 20.

The hydraulic pneumatic tensioner based lashing system of the disclosed subject matter meets a number of significant design criteria. Among others, one differentiator between this and current designs is that it is not dependent of a specific hull design, for example a deep draft spar. The hydraulic-pneumatic tensioner system maintains the lashing lines within a desired tension band while maintaining a nominal separation range without introducing the deleterious shock loads associated with fixed lines. The tension band may advantageously be informed by the maximum lashing tension load valves.

The disclosed system may be easily retrofitted into an existing structure, as all modifications are typically above water line of any of the floating structures.

The system maintains the ultimate objective of: full drilling and production operations can be conducted through a one-year environment, and limited operations can be conducted through a ten-year environment. Moreover, the connection of the gangway 18 and associated electrical, hydraulic and pneumatic connections, can be maintained through a ten-year environment. In more extreme environmental conditions, such as a 100-year storm, the gangway 18 can be disconnected from the platform 20, and the lashing lines 46 paid out to increase the separation distance substantially.

The hydraulic-pneumatic tensioning system via the associated sling shot valve 78 the system can be set into hydraulic lock; this will enable the system to becoming a fixed lashing system. This is beneficial during an initial rig up or final rig down of the TADU here the TADU 10 is brought into a close proximity of platform 20 due to potential rig-up crane hook reach limitations and a strict separation control is needed.

The particular connection mechanisms for connecting the lashing 48 to the anchor 44, and suitable alternatives will suggest themselves as equivalents to those skilled in the pertinent arts and thus are not described herein. Also, the number of lashing lines 48, as well as their particular structure, in terms of the materials and dimensions of the hawsers 48, may be varied considerably for different applications, such as the types of floating structures to be lashed together and the environmental conditions to be endured during their operation.

The type of fixed anchor connection 44 can be in the form of a rotating anchor on the platform 20 side. This may ease any operations in connection with slipping and cutting of the lashing line due to the lashing wire ton/mile maintenance requirements. The use of additional fairleads, pulleys and hawsers in directing the lashings and mooring lines is also envisioned.

While embodiments of the disclosed subject matter are discussed with the adjectives hydraulic and pneumatic, those terms are used in their fullest scope, hydraulic relating to fluids and pneumatic relating to gases. Petroleum fluids, water, oils and other non-compressible liquids and gels etc. are all considered encompassed by the use of hydraulic, while air, nitrogen, as well as other gases are encompassed by the use of pneumatic.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A system for lashing a first structure to a second structure, the first structure having a buoyant hull and floating in a body of water, the system comprising:

a plurality of winches attached to the first structure;

a plurality of hydraulic-pneumatic tensioning systems attached to the first structure, a plurality of fixed anchor points on the second structure; and, a plurality of lashing lines, each of the plurality of lashing lines extending from a respective one of the plurality of winches, through a corresponding one of the plurality of hydraulic-pneumatic tensioning systems and fixed at a corresponding one of the plurality of fixed anchor points;

wherein each of the hydraulic-pneumatic tensioning systems comprise:

a first sheave assembly fixed to a first end of a hydraulic cylinder and rod assembly;

a second sheave assembly fixed to a second end of the hydraulic cylinder and rod assembly;

an accumulator operably connected to the hydraulic cylinder and rod assembly; and a fail safe valve between the accumulator and the hydraulic cylinder and rod assembly;

wherein the operation of the fail safe valve will make the lashing system fixed by hydraulic locking.

2. The system of claim 1, wherein one of the plurality of lashing lines extending through the corresponding one of the plurality of hydraulic-pneumatic tensioning systems is reeved over the first and second sheaves of the corresponding one of the plurality of hydraulic-pneumatic tensioning systems.

3. The system of claim 1, wherein one of the plurality of the lashing lines is under a tension load, said tension load exerting a compression force on the first sheave and the second sheave of the corresponding hydraulic-pneumatic tensioning system.

4. The system of claim 1, wherein hydraulic cylinder and rod assembly pushes out on the first and second sheaves with an equal and opposite force proportional to a gas pressure in the accumulator, said gas pressure being a function of a predetermined pressure setting and a percentage of stroke of the hydraulic cylinder and ram assembly.

5. The system in claim 1, wherein the first structure has a forward end separated by a separation distance from the second structure, and wherein the plurality of lashing lines comprise a set of four lashing lines.

6. The system of claim 1, wherein the hydraulic-pneumatic tensioning systems compensate for the relative motion between the first and second structures.

7. The system of claim 4, wherein the lashing tension can be adjusted during operating by means of pressure control of gas in the accumulator.

8. The system of claim 1, wherein the hydraulic locking will enable operating of the winches on the first structure to winch the two floating structure into close proximity without adding additional fixed lines or separation structure.

9. The system of claim 1, wherein the hydraulic locking will enable an efficient pullback to safe separation during extreme weather.

10. The system of claim 9, wherein a release of the fail safe valve will make the lashing system back into compensation mode for accommodating the extreme weather criteria.

11. The system of claim 1, wherein the second structure is floating in the body of water.

12. The system of claim 1, further comprising a user accessible control panel, for controlling the pressure in the accumulator and the operation of the fail safe valve.

13. A method for lashing a first structure to a second structure, the second structure having a buoyant hull and floating in a body of water, comprising:

attaching a first end of a lashing line to a fixed anchor point on the second structure;

attaching a second end of the lashing line to a winch on the first structure;

reeving the lashing line around a first sheave and a second sheave, wherein the first sheave is fixed to a first end of a hydraulic ram and the second sheave is attached to a second end of the hydraulic ram; and, tensioning the lashing line by charging an accumulator connected to the hydraulic ram with a gas at a predetermined pressure causing the hydraulic ram to apply an equal and opposite force on the first and second sheaves respectively;

wherein the force is proportional to the predetermined pressure and the retraction of the hydraulic ram;

adjusting the position of the first structure relative to the second structure by hydraulically locking the hydraulic ram and reeling in or paying out the lashing line from the winch.

* * * * *